US008613155B1

(12) United States Patent
Gunther

(10) Patent No.: US 8,613,155 B1
(45) Date of Patent: Dec. 24, 2013

(54) GREETING CARD DISPLAY SYSTEM

(71) Applicant: Julie Gunther, Tucson, AZ (US)

(72) Inventor: Julie Gunther, Tucson, AZ (US)

( * ) Notice: Subject to any disclaimer, the term of this patent is extended or adjusted under 35 U.S.C. 154(b) by 0 days.

(21) Appl. No.: 13/685,925

(22) Filed: Nov. 27, 2012

Related U.S. Application Data

(63) Continuation-in-part of application No. 12/711,552, filed on Feb. 24, 2010, now Pat. No. 8,341,862.

(60) Provisional application No. 61/156,415, filed on Feb. 27, 2009.

(51) Int. Cl.

| | |
|---|---|
| ***G09F 3/18*** | (2006.01) |
| ***A47G 1/06*** | (2006.01) |
| ***G09F 3/10*** | (2006.01) |
| ***G09D 3/02*** | (2006.01) |
| ***G09F 1/00*** | (2006.01) |

(52) U.S. Cl.
USPC ..... 40/661; 40/701; 40/702; 40/703; 40/773; 40/722; 40/774; 40/673; 40/672; 40/122; 40/776; 40/594; 40/124.06; 206/449; 206/308.1; 229/72; 229/67.1; 229/67.4

(58) Field of Classification Search
USPC ..... 40/701–703, 773, 722, 774, 661, 673, 40/672, 122, 776, 594, 124.06; 206/459, 206/308.1; 229/72, 67.1, 67.4
See application file for complete search history.

(56) References Cited

U.S. PATENT DOCUMENTS

| | | | | |
|---|---|---|---|---|
| 253,356 | A * | 2/1882 | Edmondson | 229/72 |
| 2,718,911 | A | 9/1955 | Solomon | |
| 2,925,675 | A | 2/1960 | Lumpkin | |
| 3,696,532 | A * | 10/1972 | Nahon | 40/661 |
| 4,620,630 | A * | 11/1986 | Moss | 206/45.24 |
| 5,873,513 | A | 2/1999 | Ong | |
| 6,390,714 | B1 | 5/2002 | Bradley et al. | |
| 7,418,796 | B2 * | 9/2008 | Anastasio | 40/735 |
| 2005/0198882 | A1 | 9/2005 | Zaremba | |
| 2006/0162213 | A1 | 7/2006 | Einarson | |
| 2008/0115396 | A1 | 5/2008 | Gamboa | |

* cited by examiner

*Primary Examiner* — Syed A Islam

(57) ABSTRACT

A greeting card display system has a greeting card with a card first panel and a card second panel pivotally attached. A first crease divides a card front surface from a card back surface and a card first inside surface from a card second inside surface. The system has a protective sleeve with a sleeve first panel and a sleeve second panel. The protective sleeve has a sleeve cavity with a single sleeve opening adapted for insertion of the greeting card. The sleeve first panel is pivotally located on the sleeve second panel via a sleeve first outside crease that divides the front surface from the back surface and a sleeve first inside crease that divides the first inside surface from the second inside surface. The system has a display unit adapted to receive the protective sleeve on a display unit front surface.

20 Claims, 9 Drawing Sheets

GREETING CARD DISPLAY SYSTEM

CROSS REFERENCE

This application is a continuation-in-part of U.S. patent application Ser. No. 12/711,552 filed Feb. 24, 2010, which claims priority to U.S. Provisional Application No. 61/156,415 filed Feb. 27, 2009, the specification of which is incorporated herein by reference in its entirety.

BACKGROUND OF THE INVENTION

The custom of sending greeting cards can be traced back to ancient Chinese and Egyptian civilizations. By the 15$^{th}$ century, Europeans were printing New Year's greetings and with the continued advances in printing, the custom continued to gain in popularity. The first Christmas card was believed to have appeared in 1843 with mass production of greeting cards following shortly thereafter.

Often a receiver of a greeting card may wish to save, preserve or even display the greeting card in various manners. Some may wish to prop the greeting card up on a table, a desk, or a mantle, while others may store the greeting card in a box or photo album. The present invention features a greeting card display system that provides an aesthetically pleasing means of displaying greeting cards.

SUMMARY

The present invention features a greeting card display system. In some embodiments, the system comprises a greeting card having at least a card first panel and a card second panel.

In some embodiments, the greeting card comprises a card front surface, a card back surface, a card first inside surface, and a card second inside surface. In some embodiments, the greeting card comprises a card top edge, a card bottom edge, a card first edge, a card second edge, and a card first crease from the card top edge to the card bottom edge.

In some embodiments, the card first panel is pivotally attached to the card second panel via the first crease. In some embodiments, the first crease divides the card front surface from the card back surface and the card first inside surface from the card second inside surface. In some embodiments, in a first open position, the card first inside surface is pivoted away from the card second inside surface. In some embodiments, in a second closed position, the card first inside surface is pivoted against the card second inside surface.

In some embodiments, the system comprises a protective sleeve having at least a sleeve first panel and a sleeve second panel. In some embodiments, the protective sleeve comprises a sleeve front surface, a sleeve back surface, a sleeve first inside surface, and a sleeve second inside surface. In some embodiments, the protective sleeve comprises a sleeve top edge, a sleeve bottom edge, a sleeve first edge, a sleeve second edge, and sleeve first inside and outside creases from the sleeve top edge to the sleeve bottom edge. In some embodiments, the protective sleeve comprises a sleeve cavity located therein from the sleeve top edge to the sleeve bottom edge and the sleeve first edge to the sleeve second edge. In some embodiments, the protective sleeve comprises a single sleeve opening fluidly connected to the sleeve cavity located on the sleeve top edge, the sleeve bottom edge, the sleeve first edge, or the sleeve second edge. In some embodiments, the single sleeve opening is adapted for insertion of the greeting card.

In some embodiments, the protective sleeve comprises at least three sealed edges located on any combination of the sleeve top edge, the sleeve bottom edge, the sleeve first edge, or the sleeve second edge. In some embodiments, the sleeve first panel is pivotally located on the sleeve second panel via the sleeve first inside crease and the sleeve first outside crease. In some embodiments, the sleeve first outside crease divides the front surface from the back surface and the sleeve first inside crease divides the first inside surface from the second inside surface. In some embodiments, the sleeve first inside crease and the first outside crease each lay on a plane, Plane A.

In some embodiments, in a first open position, the sleeve first inside surface is pivoted away from the sleeve second inside surface. In some embodiments, in a second closed position, the sleeve first inside surface is pivoted against the sleeve second inside surface. In some embodiments, in the first open position and the second dosed position, the sleeve first inside crease and the sleeve first outside crease each lay on Plane A. In some embodiments, the protective sleeve comprises a general shape of an envelope.

In some embodiments, the sleeve front surface, the sleeve first inside surface, and the sleeve second inside surface are transparent, semi-transparent or translucent. In some embodiments, the protective sleeve comprises a first attaching means located on a sleeve back surface thereon.

In some embodiments, the system comprises a display unit having a display unit front surface and a display unit back surface. In some embodiments, the display unit front surface is adapted to receive the protective sleeve located thereon via a second attaching means. In some embodiments, the second attaching means is adapted to receive the first attaching means. In some embodiments, the display unit back surface comprises a display unit mounting component located thereon.

In some embodiments, the protective sleeve is moved into a first open position. In some embodiments, the greeting card is inserted into the sleeve cavity of the protective sleeve via the sleeve opening. In some embodiments, the protective sleeve is located on the display unit via the first attaching means and the second attaching means. In some embodiments, the protective sleeve is moved into a second closed position.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

| | |
|---|---|
| 100 | Greeting card display system |
| 200 | Greeting card |
| 210 | Card first panel |
| 220 | Card second panel |
| 230 | Card front surface |
| 240 | Card back surface |
| 250 | Card first inside surface |
| 260 | Card second inside surface |
| 270 | Card top edge |
| 280 | Card bottom edge |
| 290 | Card first edge |
| 300 | Card second edge |
| 310 | Card first crease |
| 400 | Protective sleeve |
| 410 | Sleeve first panel |
| 420 | Sleeve second panel |
| 430 | Sleeve front surface |
| 440 | Sleeve back surface |
| 450 | Sleeve first inside surface |
| 460 | Sleeve second inside surface |
| 470 | Sleeve top edge |
| 480 | Sleeve bottom edge |
| 490 | Sleeve first edge |
| 500 | Sleeve second edge |
| 510 | Sleeve first inside crease |
| 520 | Sleeve first outside crease |
| 530 | Sleeve cavity |
| 540 | Sleeve opening |
| 550 | Plane A |
| 560 | First attaching means |
| 600 | Display unit |
| 610 | Display unit front surface |
| 620 | Display unit back surface |
| 630 | Second attaching means |
| 640 | Display unit mounting component |
| 700 | Card third panel |
| 710 | Card third panel first edge |
| 720 | Sleeve third panel |
| 730 | Sleeve third panel first inside edge |
| 740 | Sleeve third panel first outside edge |
| 750 | Decorative component |
| 760 | Sleeve first edge panel |
| 770 | Sleeve second edge panel |
| 780 | Sleeve third edge panel |
| 790 | Sealing means |
| 800 | Sleeve cavity inside surface |
| 810 | Magnification component |
| 820 | Recess |

Figure 1:
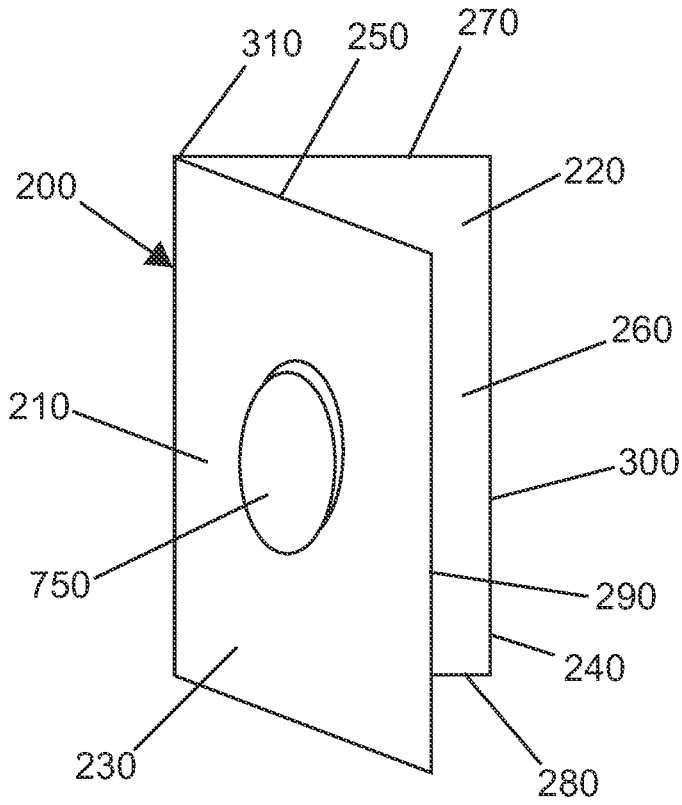
FIG. 1 is a perspective view of the greeting card of the present invention.
Figure 2:
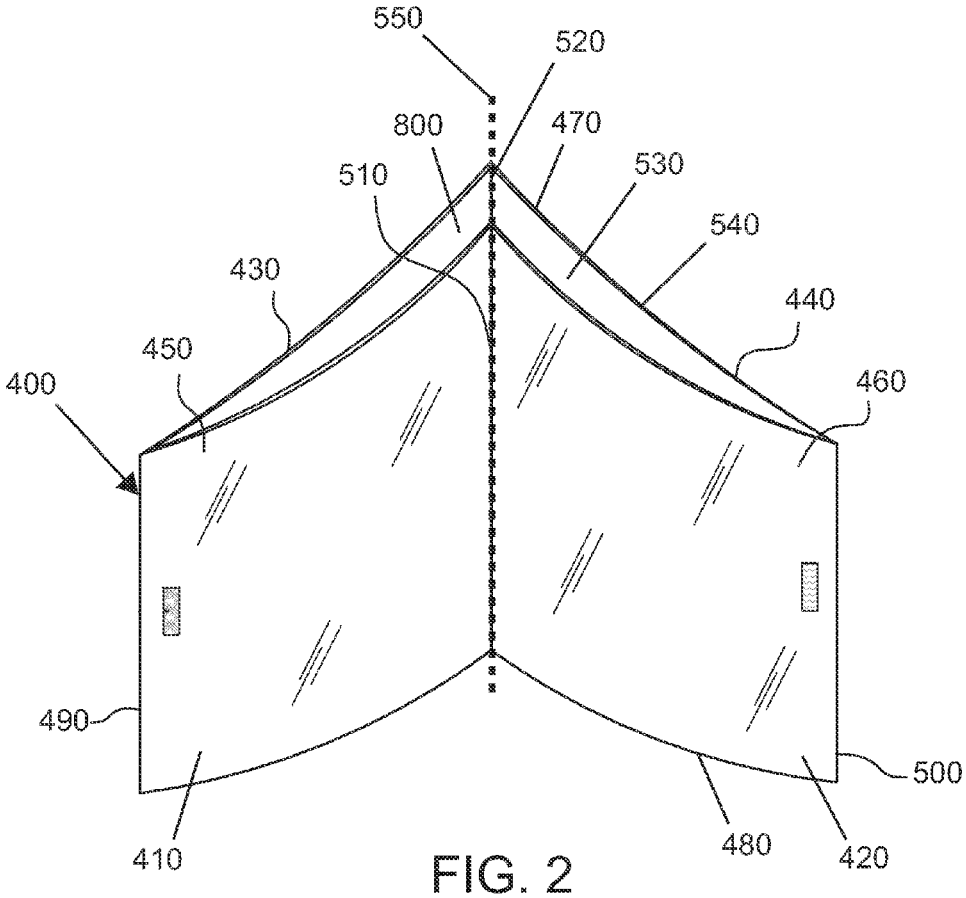
FIG. 2 is a perspective view of the protective sleeve of the present invention.
Figure 3:
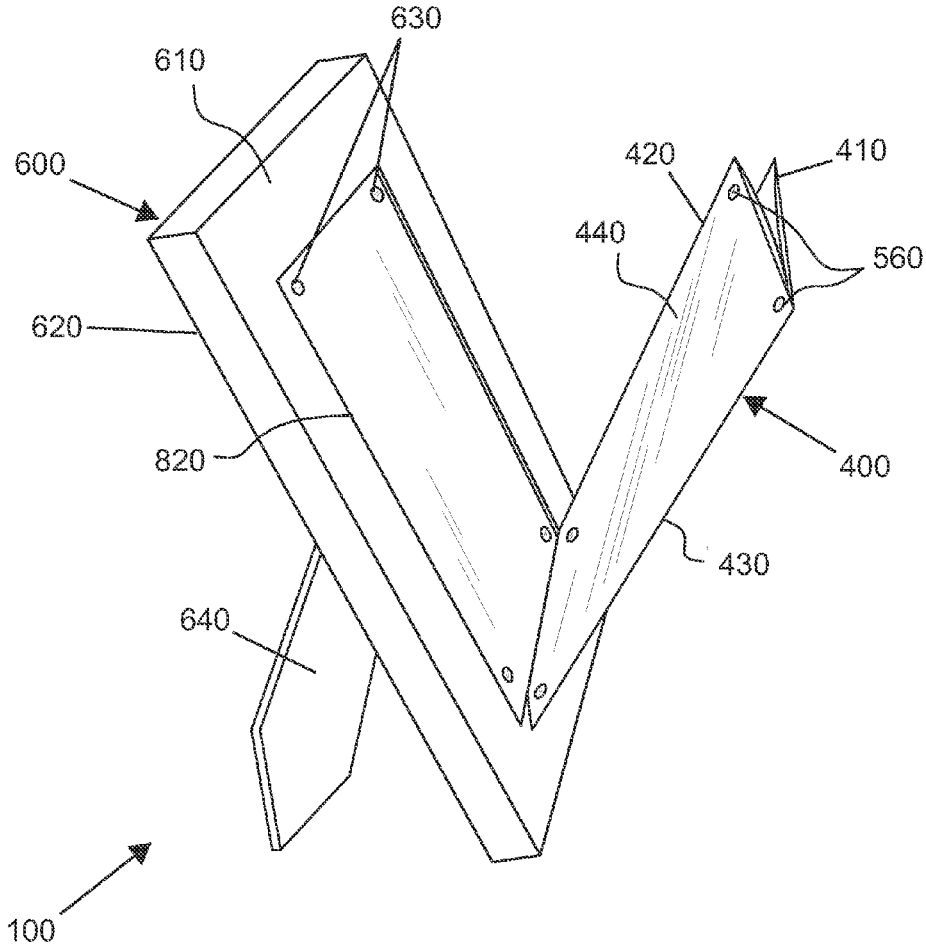
FIG. 3 is a perspective view of the present invention.
Figure 4:
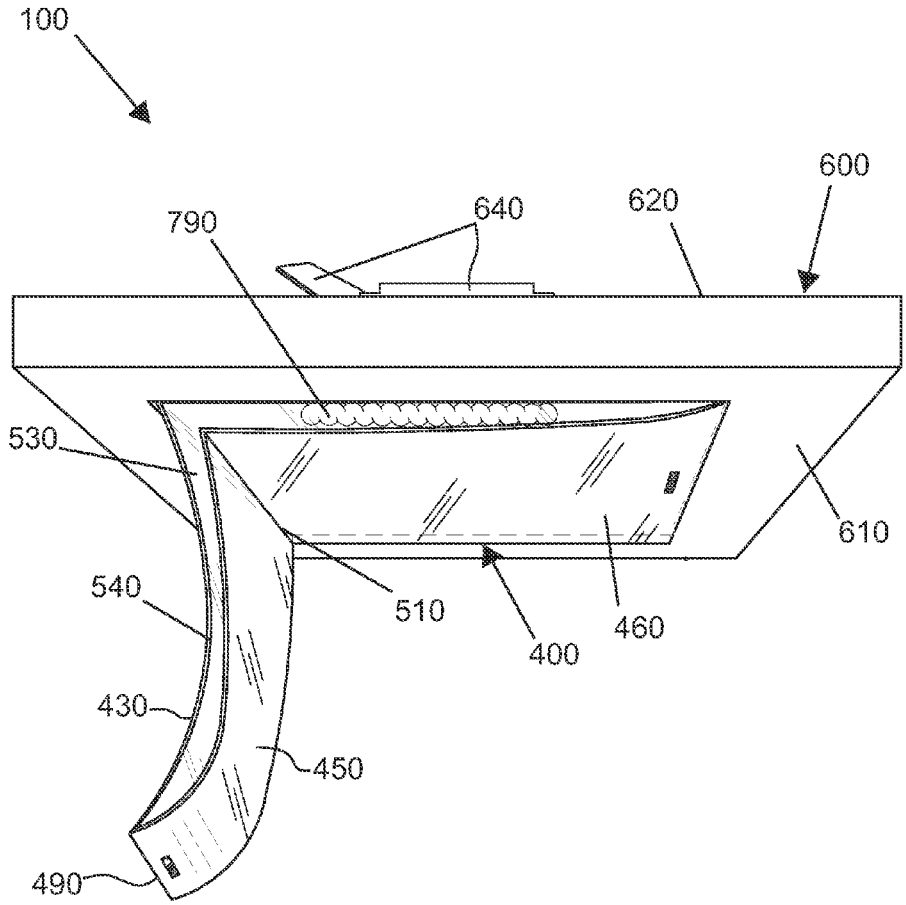
FIG. 4 is a top view of the present invention.
Figure 5:
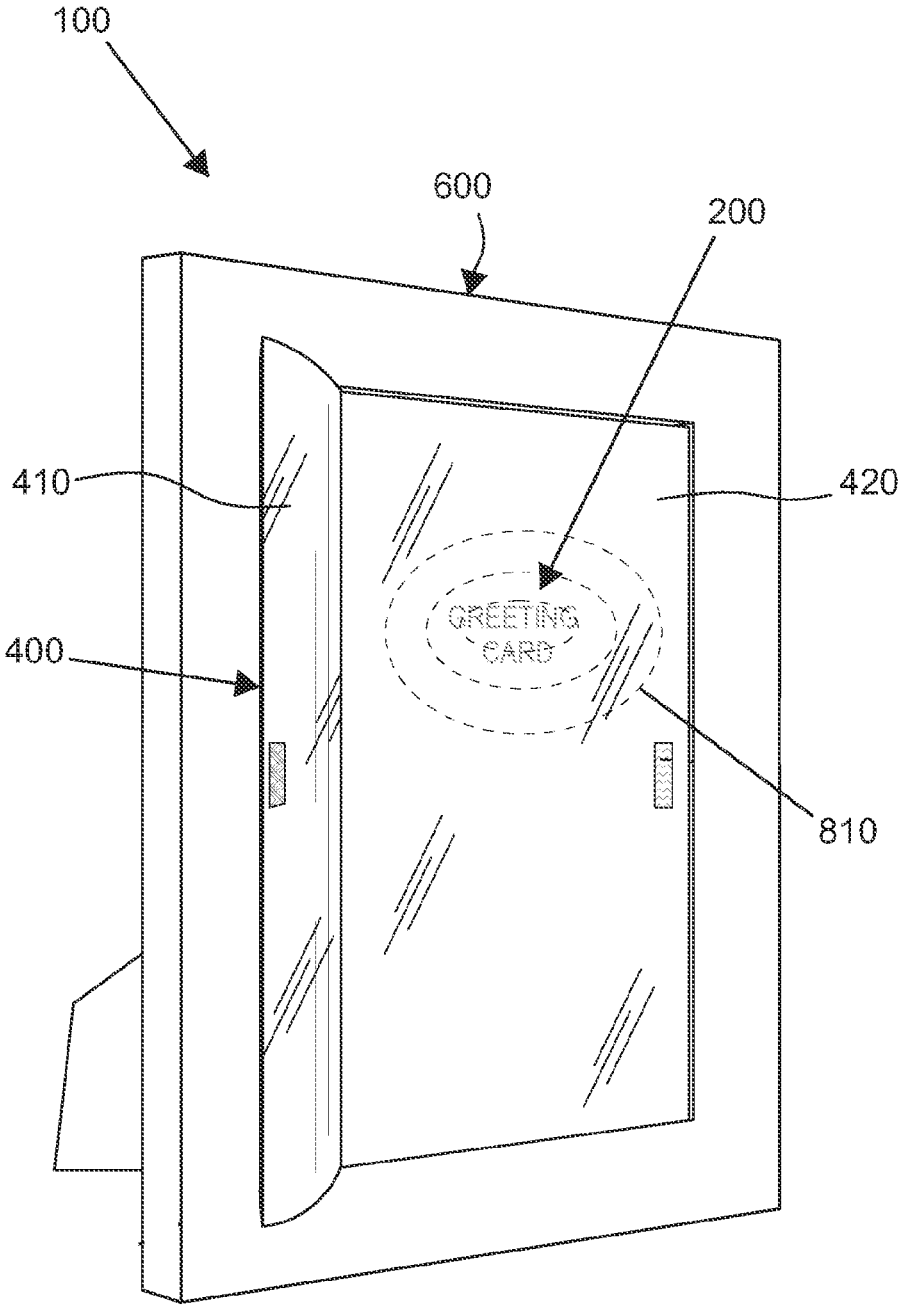
FIG. 5 is a front view of the present invention.
Figure 6:
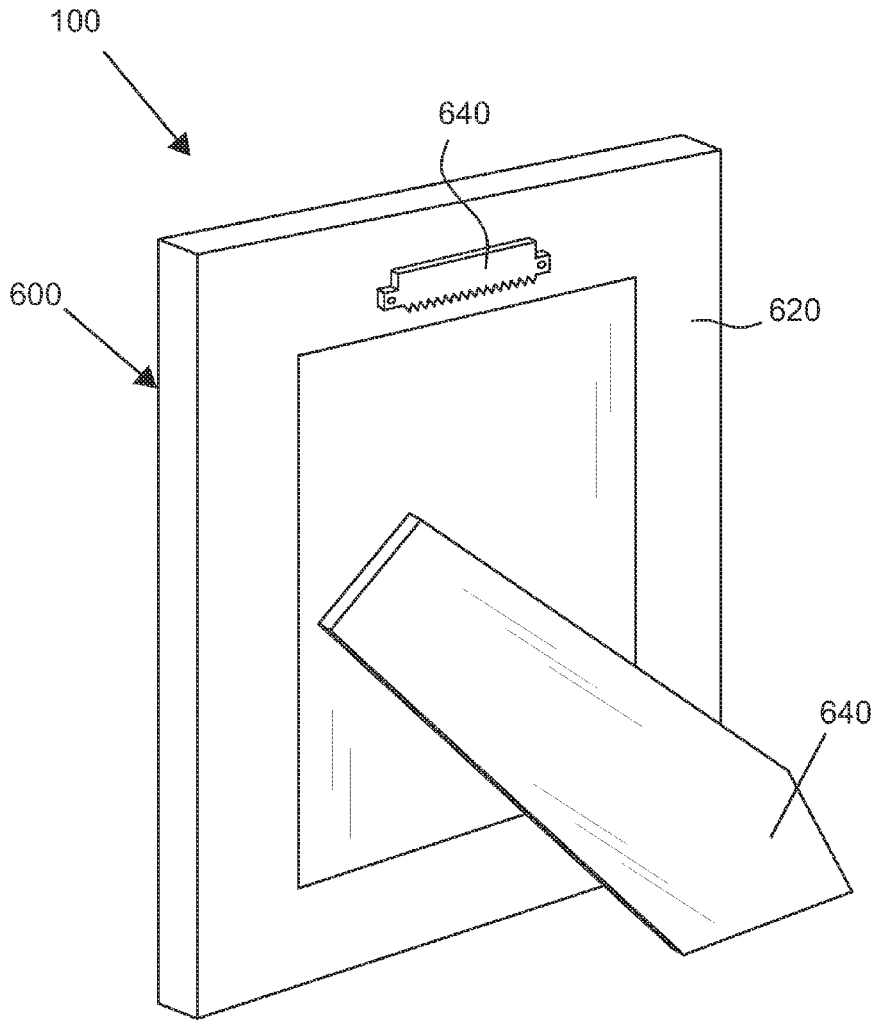
FIG. 6 is a rear view of the present invention.
Figure 7:
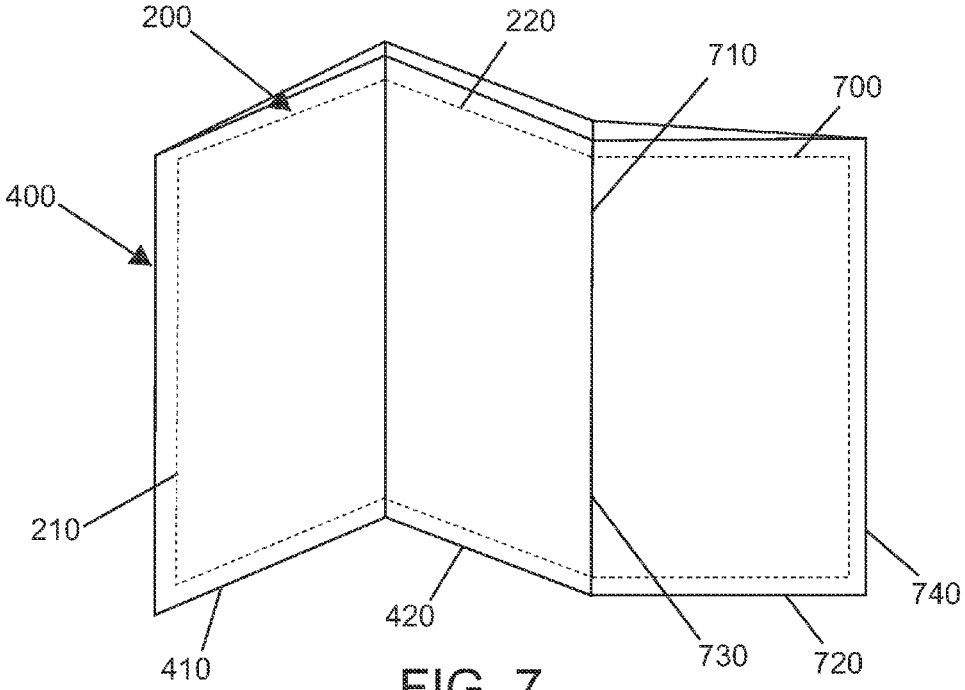
FIG. 7 is a perspective view of an alternate embodiment of the greeting card and the protective sleeve of the present invention.
Figure 8:
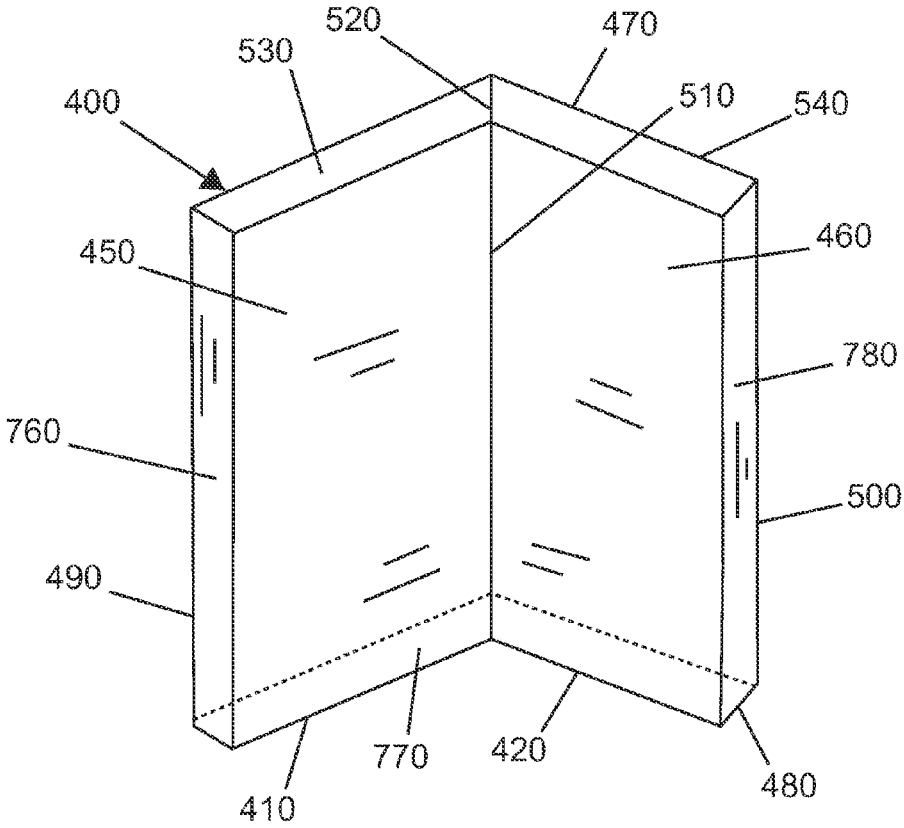
FIG. 8 is a front view of an alternate embodiment of the protective sleeve of the present invention.
Figure 9:
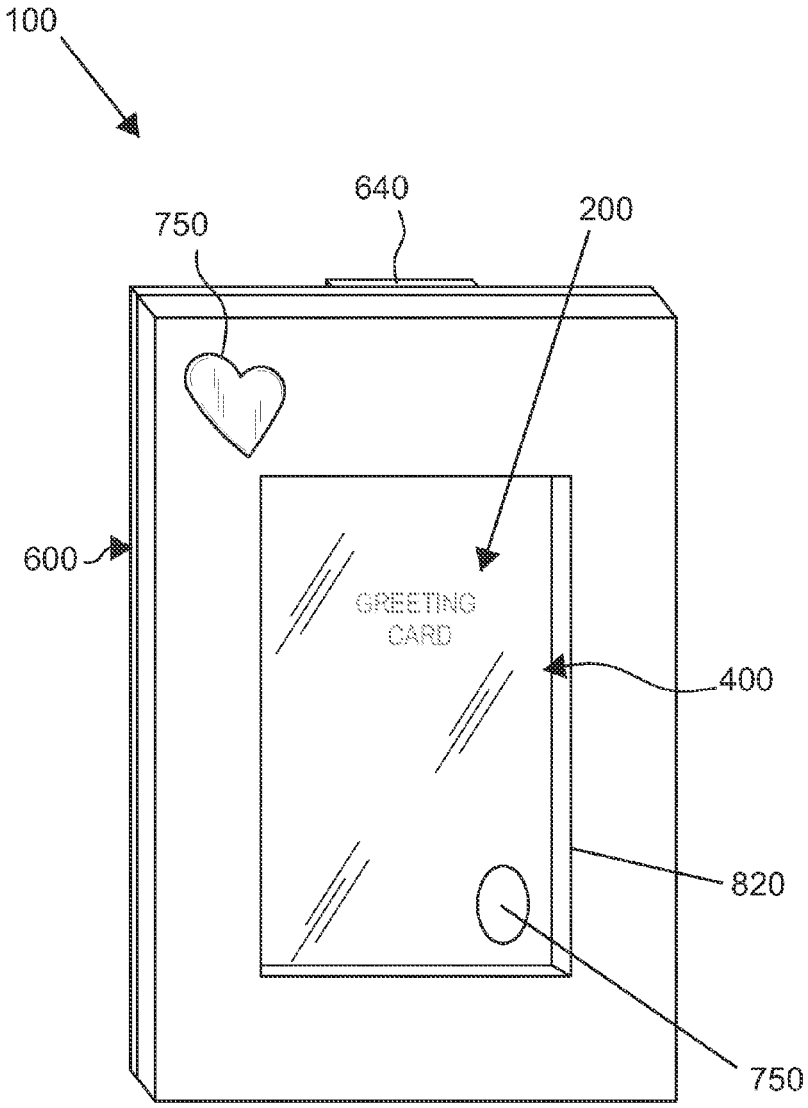
FIG. 9 is a front view of an alternate embodiment of the present invention.

Referring now to FIG. 1-9, the present invention features a greeting card display system (100) for preserving and displaying a greeting card (200). In some embodiments, the system (100) comprises a greeting card (200) having at least a card first panel (210) and a card second panel (220). In some embodiments, the greeting card (200) comprises a card front surface (230) located on a card first panel (210), a card back surface (240) located on a card second panel (220), a card first inside surface (250) located on the card first panel (210) opposed to the card front surface (230), a card second inside surface (260) located on the card second panel (220) opposed to the card back surface (240), a card top edge (270) located on the card first panel (210) and the card second panel (220), a card bottom edge (280) located on the card first panel (210) and the card second panel (220) opposed to the card top edge (270), a card first edge (290) located on the card first panel (210), a card second edge (300 located on the card second panel (220), and a card first crease (310) located from the card top edge (270) to the card bottom edge (280). In some embodiments, the card first panel (210) is pivotally located on the card second panel (220) via the card first crease (310). In some embodiments, the card first crease (310) divides the card front surface (230) from the card back surface (240) and the card first inside surface (250) from the card second inside surface (260). In some embodiments, the card first crease (310) evenly divides the card front surface (230) from the card back surface (240) and the card first inside surface (250) from the card second inside surface (260). In some embodiments, the card first crease (310) unevenly divides the card front surface (230) from the card back surface (240) and the card first inside surface (250) from the card second inside surface (260).

In some embodiments, in a first open position, the card first inside surface (250) is pivoted away from the card second inside surface (260). In some embodiments, in a second closed position, the card first inside surface (250) is pivoted to interface with and against the card second inside surface (260).

In some embodiments, the system (100) comprises a protective sleeve (400) having at least a sleeve first panel (410) and a sleeve second panel (420). In some embodiments, the protective sleeve (400) comprises a sleeve front surface (430) located on a sleeve first panel (410), a sleeve back surface (440) located on a sleeve second panel (420), a sleeve first inside surface (450) located on the sleeve first panel (410) opposed to the sleeve front surface (430), a sleeve second inside surface (460) located on the sleeve second panel (420) opposed to the sleeve back surface (440), a sleeve top edge (470) located on the sleeve first panel (410) and the sleeve second panel (420), a sleeve bottom edge (480) located on the sleeve first panel (410) and the sleeve second panel (420) opposed to the sleeve top edge (470), a sleeve first edge (490) located on the sleeve first panel (410), a sleeve second edge (500) located on the sleeve second panel (420), a sleeve first inside crease (510) located from the sleeve top edge (470) to the sleeve bottom edge (480), and a sleeve first outside crease (520) located from the sleeve top edge (470) to the sleeve bottom edge (480). In some embodiments, the protective sleeve (400) comprises a sleeve cavity (530) located therein from the sleeve top edge (470) to the sleeve bottom edge (480) and the sleeve first edge (490) to the sleeve second edge (500). In some embodiments, the sleeve cavity (530) passes through and is not divided by the sleeve first inside crease (510) and the sleeve first outside crease (520). In some embodiments, the protective sleeve (400) comprises a single sleeve opening (540) fluidly connected to the sleeve cavity (530) located on the sleeve top edge (470), the sleeve bottom edge (480), the sleeve first edge (490), or the sleeve second edge (500). In some embodiments, the single sleeve opening (540) is adapted for insertion of the greeting card (200). In some embodiments, the protective sleeve (400) comprises at least three sealed edges located on any combination of the sleeve top edge (470), the sleeve bottom edge (480), the sleeve first edge (490), or the sleeve second edge (500).

In some embodiments, the sleeve first panel (410) is pivotally located on the sleeve second panel (420) via the sleeve first inside crease (510) and the sleeve first outside crease (520). In some embodiments, the sleeve first outside crease (520) divides the sleeve front surface (430) from the sleeve back surface (440), and the sleeve first inside crease (510) divides the sleeve first inside surface (450) from the sleeve second inside surface (460). In some embodiments, the sleeve first inside crease (510) and the sleeve first outside crease (520) each lay on a plane, Plane A (550). In some embodiments, in a first open position, the sleeve first inside surface (450) is pivoted away from the sleeve second inside surface (460). In some embodiments, in a second closed position, the sleeve first inside surface (450) is pivoted to interface with and against the sleeve second inside surface (460). In some embodiments, in the first open position, the sleeve first inside crease (510) and the sleeve first outside crease (520) each lay on Plane A (550). In some embodiments, in a second closed position, the sleeve first inside crease (510) and the sleeve first outside crease (520) each lay on Plane A (550).

In some embodiments, the protective sleeve (400) comprises a general shape of an envelope, for example, having an open edge connected to a cavity surrounded by sealed edges. In some embodiments the sleeve front surface (430), the sleeve first inside surface (450), and the sleeve second inside surface (460) are transparent, semi-transparent or translucent. In some embodiments, the sleeve back surface (440) comprises a first attaching means (560).

In some embodiments, the system (100) comprises a display unit (600) having a display unit front surface (610) and a display unit back surface (620). In some embodiments, the display unit front surface (610) is adapted to receive the protective sleeve (400) located thereon via a second attaching means (630). In some embodiments, the second attaching means (630) adapted to connect to and receive the first attaching means (560). In some embodiments, the display unit back surface (620) comprises a display unit mounting component (640) located thereon.

In some embodiments, the protective sleeve (400) is moved into the first open position. In some embodiments, the greeting card (200) is inserted into the sleeve cavity (530) of the protective sleeve (400) via the sleeve opening (540). In some embodiments, the protective sleeve (400) is attached to the display unit (600) via the first attaching means (560) and the second attaching means (630). In some embodiments, the protective sleeve (400) is moved into the second closed position.

In some embodiments, the greeting card (200) comprises a card third panel (700) having a card third panel first edge (710) pivotally located on the card second edge (300). In some embodiments, the protective sleeve (400) comprises a sleeve third panel (720) having a sleeve third panel first inside edge (730) pivotally located on the sleeve front surface of the sleeve second edge (500) and the sleeve third panel first outside edge (740) pivotally located on the sleeve back surface of the sleeve second edge (500).

In some embodiments, the card first panel (210) comprises a decorative component (750) located thereon having a thickness, wherein the card first panel (210) comprises a thickness between 0 inches and ½ inches at a thickest point between the card front surface (230) having the decorative component (750) located thereon and the card first inside surface (250). In some embodiments, the protective sleeve (400) comprises a sleeve first edge panel (760), a sleeve second edge panel (770) and a sleeve third edge panel (780). In some embodiments, the sleeve first edge panel (760), the sleeve second edge panel (770) and the sleeve third edge panel (780) each comprise a width adapted to accommodate the card first panel (210) comprising the decorative component (750) located thereon. In some embodiments, the sleeve first edge panel (760) is located at the sleeve first edge (490) having edges fluidly connecting the sleeve front surface (430) to the sleeve back surface (440). In some embodiments, the sleeve second edge panel (770) is located at the sleeve bottom edge (480) or the sleeve top edge (470) having edges fluidly connecting the sleeve front surface (430) to the sleeve back surface (440). In some embodiments, the sleeve third edge panel (780) is located at the sleeve second edge (500) having edges fluidly connecting the sleeve front surface (430) to the sleeve back surface (440).

In some embodiments, the single sleeve opening (540) comprises a sealing means (790) located thereon. In some embodiments, the sealing means (790) is reopenable and resealable. In some embodiments, the sealing means (790) is a hook and loop system. In some embodiments, the sealing means (790) is an adhesive.

In some embodiments, a sleeve cavity inside surface (800) comprises a non-stick coating located thereon. In some embodiments, the non-stick coating prevents the card front surface (230) or the card back surface (240) from sticking to the sleeve cavity inside surface (800).

In some embodiments, the protective sleeve (400) comprises a decorative component (750) located on a sleeve front surface (430) thereon. In some embodiments, the display unit (600) comprises a decorative component (750) located on a display unit front surface (610) thereon.

In some embodiments, the display unit mounting component (640) is a hook. In some embodiments, the display unit mounting component (640) is a pivotally mounted prop.

In some embodiments, the sleeve first panel (410) and the sleeve second panel (420) are bendable and are constructed from a bendable material. For example, polyethylene or vinyl.

In some embodiments, the sleeve first panel (410) and the sleeve second panel (420) are rigid and are constructed from a rigid material. For example, acrylic or polycarbonate.

In some embodiments, the protective sleeve (400) is constructed from a material that comprises an ultra-violet radiation protection component. For example, from the family of benzophenones, to minimize degradation of the greeting card (200) from ultra-violet radiation.

In some embodiments, the protective sleeve (400) is constructed from a material that is polarized.

In some embodiments, the protective sleeve (400) comprises a magnification component (810) located on a sleeve front surface (430), a sleeve first inside surface (450), a sleeve second inside surface (460), or any combination thereof.

In some embodiments, the sleeve first edge (490), the sleeve second edge (500), and the sleeve bottom edge (480) are sealed.

In some embodiments, the sleeve top edge (470), the sleeve bottom edge (480), and either the sleeve first edge (490), or the sleeve second edge (500) are sealed.

In some embodiments, the display unit front surface (610) comprises a recess (820) embedded therein adapted to receive the protective sleeve (400). In some embodiments, the recess (820) is a groove.

In some embodiments, a securing means is located on either the sleeve first inside surface (450), the sleeve second inside surface (460) or both to attach hold the protective sleeve (400) is the second closed position. In some embodiments, the securing means, the first attaching means (560), and the second attaching means (630) are a hook and loop system, an adhesive system, a magnet system, a snap system, a hook system, or a button system.

In some embodiments, a handle is located on the sleeve first panel (410) adapted to enable to serve as a grasp for opening the protective sleeve (400). In some embodiments, an indicator tab is located on the sleeve first panel (410) or the sleeve second panel (420) that is adapted to serve as a label. In some embodiments, a tab is disposed on the sleeve first panel (410) or the sleeve second panel (420) that is adapted to serve as a mounting tab for placing the protective sleeve (400) in a book or a binder.

In some embodiments, a method of displaying a greeting card (200) comprises obtaining a greeting card display system (100). In some embodiments, the system comprises a greeting card (200) having at least a card first panel (210) and a card second panel (220). In some embodiments, the greeting card (200) comprises a card front surface (230) located on a card first panel (210), a card back surface (240) located on a card second panel (220), a card first inside surface (250) located on the card first panel (210) opposed to the card front surface (230), a card second inside surface (260) located on the card second panel (220) opposed to the card back surface (240), a card top edge (270) located on the card first panel (210) and the card second panel (220), a card bottom edge (280) located on the card first panel (210) and the card second panel (220) opposed to the card top edge (270), a card first edge (290) located on the card first panel (210), a card second edge (300 located on the card second panel (220), and a card first crease (310) located from the card top edge (270) to the card bottom edge (280). In some embodiments, the card first panel (210) is pivotally located on the card second panel (220) via the card first crease (310). In some embodiments, the card first crease (310) divides the card front surface (230) from the card back surface (240) and the card first inside surface (250) from the card second inside surface (260). In some embodiments, in a first open position, the card first inside surface (250) is pivoted away from the card second inside surface (260). In some embodiments, in a second closed position, the card first inside surface (250) is pivoted against the card second inside surface (260).

In some embodiments, the system comprises a protective sleeve (400) having at least a sleeve first panel (410) and a sleeve second panel (420). In some embodiments, the protective sleeve (400) comprises a sleeve front surface (430) located on a sleeve first panel (410), a sleeve back surface (440) located on a sleeve second panel (420), a sleeve first inside surface (450) located on the sleeve first panel (410) opposed to the sleeve front surface (430), a sleeve second inside surface (460) located on the sleeve second panel (420) opposed to the sleeve back surface (440), a sleeve top edge (470) located on the sleeve first panel (410) and the sleeve second panel (420), a sleeve bottom edge (480) located on the sleeve first panel (410) and the sleeve second panel (420) opposed to the sleeve top edge (470), a sleeve first edge (490) located on the sleeve first panel (410), a sleeve second edge (500) located on the sleeve second panel (420), a sleeve first inside crease (510) located from the sleeve top edge (470) to the sleeve bottom edge (480), and a sleeve first outside crease (520) located from the sleeve top edge (470) to the sleeve bottom edge (480). In some embodiments, the protective sleeve (400) comprises a sleeve cavity (530) located therein from the sleeve top edge (470) to the sleeve bottom edge (480) and the sleeve first edge (490) to the sleeve second edge (500). In some embodiments, the sleeve cavity (530) passes through and is not divided by the sleeve first inside crease (510) and the sleeve first outside crease (520). In some embodiments, the protective sleeve (400) comprises a single sleeve opening (540) fluidly connected to the sleeve cavity (530) located on the sleeve top edge (470), the sleeve bottom edge (480), the sleeve first edge (490), or the sleeve second edge (500). In some embodiments, the single sleeve opening (540) is adapted for insertion of the greeting card (200). In some embodiments, the protective sleeve (400) comprises at least three sealed edges located on any combination of the sleeve top edge (470), the sleeve bottom edge (480), the sleeve first edge (490), or the sleeve second edge (500). In some embodiments, the sleeve first panel (410) is pivotally located on the sleeve second panel (420) via the sleeve first inside crease (510) and the sleeve first outside crease (520). In some embodiments, the sleeve first outside crease (520) divides the sleeve front surface (430) from the sleeve back surface (440) and the sleeve first inside crease (510) divides the sleeve first inside surface (450) from the sleeve second inside surface (460). In some embodiments, the sleeve first inside crease (510) and the sleeve first outside crease (520) each lie on a plane, Plane A (550). In some embodiments, in a first open position, the sleeve first inside surface (450) is pivoted away from the sleeve second inside surface (460). In some embodiments, in a second closed position, the sleeve first inside surface (450) is pivoted against the sleeve second inside surface (460). In some embodiments, the protective sleeve (400) comprises a general shape of an envelope. In some embodiments, the sleeve front surface (430), the sleeve first inside surface (450), and the sleeve second inside surface (460) are transparent, semi-transparent or translucent. In some embodiments, the sleeve back surface (440) comprises a first attaching means (560).

In some embodiments the system comprises a display unit (600) having a display unit front surface (610) and a display unit back surface (620). In some embodiments, the display unit front surface (610) is adapted to receive the protective sleeve (400) located thereon via a second attaching means (630). In some embodiments, the second attaching means (630) adapted to receive the first attaching means (560). In some embodiments, the display unit back surface (620) comprises a display unit mounting component (640) located thereon.

In some embodiments, the method comprises moving the protective sleeve (400) into the first open position. In some embodiments, the method comprises inserting the greeting card (200) into the sleeve cavity (530) of the protective sleeve (400) via the sleeve opening (540). In some embodiments, the method comprises disposing the protective sleeve (400) on the display unit (600) via the first attaching means (560) and the second attaching means (630). In some embodiments, the method comprises moving the protective sleeve (400) into the second closed position. In some embodiments, the method comprises hanging the display unit (600) on a vertical surface or setting the display unit (600) on a horizontal surface via the display unit mounting component (640).

As used herein, the term "about" refers to plus or minus 10% of the referenced number. For example, an embodiment wherein the protective sleeve is about 10 inches in length includes a protective sleeve that is between 9 and 11 inches in length.

The disclosures of the following U.S. Patents are incorporated in their entirety by reference herein: U.S. Pat. No. 253,356; U.S. Pat. No. 3,696,532; U.S. Pat. No. 4,620,630; U.S. Pat. No. 6,696,532; and U.S. Pat. No. 7,418,796.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A greeting card display system (100) for preserving and displaying a greeting card (200), wherein said system (100) comprises:

(a) a greeting card (200) having at least a card first panel (210) and a card second panel (220), wherein the greeting card (200) comprises a card front surface (230) disposed on a card first panel (210), a card back surface (240) disposed on a card second panel (220), a card first inside surface (250) disposed on the card first panel (210) opposed to the card front surface (230), a card second inside surface (260) disposed on the card second panel (220) opposed to the card back surface (240), a card top edge (270) disposed on the card first panel (210) and the card second panel (220), a card bottom edge (280) disposed on the card first panel (210) and the card second panel (220) opposed to the card top edge (270), a card first edge (290) disposed on the card first panel (210), a card second edge (300 disposed on the card second panel (220), and a card first crease (310) disposed from the card top edge (270) to the card bottom edge (280), wherein the card first panel (210) is pivotally disposed on the card second panel (220) via the card first crease (310), wherein the card first crease (310) divides the card front surface (230) from the card back surface (240) and the card first inside surface (250) from the card second inside surface (260), wherein in a first open position, the card first inside surface (250) is pivoted away from the card second inside surface (260), wherein in a second closed position, the card first inside surface (250) is pivoted interfacingly against the card second inside surface (260);

(b) a protective sleeve (400) having at least a sleeve first panel (410) and a sleeve second panel (420), wherein the protective sleeve (400) comprises a sleeve front surface (430) disposed on a sleeve first panel (410), a sleeve back surface (440) disposed on a sleeve second panel (420), a sleeve first inside surface (450) disposed on the sleeve first panel (410) opposed to the sleeve front surface (430), a sleeve second inside surface (460) disposed on the sleeve second panel (420) opposed to the sleeve back surface (440), a sleeve top edge (470) disposed on the sleeve first panel (410) and the sleeve second panel (420), a sleeve bottom edge (480) disposed on the sleeve first panel (410) and the sleeve second panel (420) opposed to the sleeve top edge (470), a sleeve first edge (490) disposed on the sleeve first panel (410), a sleeve second edge (500) disposed on the sleeve second panel (420), a sleeve first inside crease (510) disposed from the sleeve top edge (470) to the sleeve bottom edge (480), and a sleeve first outside crease (520) disposed from the sleeve top edge (470) to the sleeve bottom edge (480), wherein the protective sleeve (400) comprises a sleeve cavity (530) disposed therein from the sleeve top edge (470) to the sleeve bottom edge (480) and the sleeve first edge (490) to the sleeve second edge (500), wherein the sleeve cavity (530) passes through and is not divided by the sleeve first inside crease (510) and the sleeve first outside crease (520), wherein the protective sleeve (400) comprises a single sleeve opening (540) fluidly connected to the sleeve cavity (530) disposed on the sleeve top edge (470), the sleeve bottom edge (480), the sleeve first edge (490), or the sleeve second edge (500), wherein the single sleeve opening (540) is adapted for insertion of the greeting card (200), wherein the protective sleeve (400) comprises at least three sealed edges disposed on any combination of the sleeve top edge (470), the sleeve bottom edge (480), the sleeve first edge (490), or the sleeve second edge (500), wherein the sleeve first panel (410) is pivotally disposed on the sleeve second panel (420) via the sleeve first inside crease (510) and the sleeve first outside crease (520), wherein the sleeve first outside crease (520) divides the sleeve front surface (430) from the sleeve back surface (440) and the sleeve first inside crease (510) divides the sleeve first inside surface (450) from the sleeve second inside surface (460), wherein the sleeve first inside crease (510) and the sleeve first outside crease (520) each lay on a plane, Plane A (550), wherein in a first open position, the sleeve first inside surface (450) is pivoted away from the sleeve second inside surface (460), wherein in a second closed position, the sleeve first inside surface (450) is pivoted interfacingly against the sleeve second inside surface (460), wherein the protective sleeve (400) comprise a general shape of an envelope, wherein the sleeve front surface (430), the sleeve first inside surface (450), and the sleeve second inside surface (460) are transparent, semi-transparent or translucent, wherein the sleeve back surface (440) comprises a first attaching means (560); and (c) a display unit (600) having a display unit front surface (610) and a display unit back surface (620), wherein the display unit front surface (610) is adapted to receive the protective sleeve (400) disposed thereon via a second attaching means (630), wherein the second attaching means (630) adapted to connectably receive the first attaching means (560), wherein the display unit back surface (620) comprises a display unit mounting component (640) disposed thereon;

wherein the protective sleeve (400) is moved into the first open position, wherein the greeting card (200) is inserted into the sleeve cavity (530) of the protective sleeve (400) via the sleeve opening (540), wherein the protective sleeve (400) is disposed on the display unit (600) via the first attaching means (560) and the second attaching means (630), wherein the protective sleeve (400) is moved into the second closed position.

2. The system (100) of claim 1, wherein the greeting card (200) comprises a card third panel (700) having a card third panel first edge (710) pivotally disposed on the card second edge (300).

3. The system (100) of claim 2, wherein the protective sleeve (400) comprises a sleeve third panel (720) having a sleeve third panel first inside edge (730) pivotally disposed on the sleeve front surface of the sleeve second edge (500) and the sleeve third panel first outside edge (740) pivotally disposed on the sleeve back surface of the sleeve second edge (500).

4. The system (100) of claim 1, wherein the card first panel (210) comprises a decorative component (750) disposed thereon having a thickness, wherein the card first panel (210) comprises a thickness between 0 inches and ½ inches at a thickest point between the card front surface (230) having the decorative component (750) disposed thereon and the card first inside surface (250).

5. The system (100) of claim 4, wherein the protective sleeve (400) comprises a sleeve first edge panel (760), a sleeve second edge panel (770) and a sleeve third edge panel (780), wherein the sleeve first edge panel (760), a sleeve second edge panel (770) and a sleeve third edge panel (780) each comprise a width adapted to accommodate the first panel comprising a decorating component disposed thereon, wherein the sleeve first edge panel (760) is disposed at the sleeve first edge (490) having edges fluidly connecting the sleeve front surface (430) to the sleeve back surface (440), wherein the sleeve second edge panel (770) is disposed at the sleeve bottom edge (480) or the sleeve top edge (470) having edges fluidly connecting the sleeve front surface (430) to the sleeve back surface (440), wherein the sleeve third edge panel (780) is disposed at the sleeve second edge (500) having edges fluidly connecting the sleeve front surface (430) to the sleeve back surface (440).

6. The system (100) of claim 1, wherein the single sleeve opening (540) comprises a sealing means (790) disposed thereon.

7. The system (100) of claim 6, wherein the sealing means (790) is reopenable and resealable.

8. The system (100) of claim 1, wherein a sleeve cavity inside surface (800) comprises a non-stick coating disposed thereon.

9. The system (100) of claim 1, wherein the protective sleeve (400) comprises a decorative component (750) disposed on a sleeve front surface (430) thereon.

10. The system (100) of claim 1, wherein the display unit mounting component (640) is a hook.

11. The system (100) of claim 1, wherein the display unit mounting component (640) is a pivotally mounted prop.

12. The system (100) of claim 1, wherein the sleeve first panel (410) and the sleeve second panel (420) are bendable and are constructed from a bendable material.

13. The system (100) of claim 1, wherein the sleeve first panel (410) and the sleeve second panel (420) are rigid and are constructed from a rigid material.

14. The system (100) of claim 1, wherein the protective sleeve (400) is constructed from a material that comprises an ultra-violet radiation protection component.

15. The system (100) of claim 1, wherein the protective sleeve (400) is constructed from a material that is polarized.

16. The system (100) of claim 1, wherein the protective sleeve (400) comprises a magnification component (810) disposed on a sleeve front surface (430), a sleeve first inside surface (450), a sleeve second inside surface (460), or any combination thereof.

17. The system (100) of claim 1, wherein the sleeve first edge (490), the sleeve second edge (500), and the sleeve bottom edge (480) are sealed.

18. The system (100) of claim 1, wherein the sleeve top edge (470), the sleeve bottom edge (480), and either the sleeve first edge (490), or the sleeve second edge (500) are sealed.

19. The system (100) of claim 1, wherein the display unit front surface (610) comprises a recess (820) embedded therein adapted to receive the protective sleeve (400).

20. A method of displaying a greeting card (200), wherein said method comprises:

(a) obtaining a greeting card display system (100) comprising:

(i) a greeting card (200) having at least a card first panel (210) and a card second panel (220), wherein the greeting card (200) comprises a card front surface (230) disposed on a card first panel (210), a card back surface (240) disposed on a card second panel (220), a card first inside surface (250) disposed on the card first panel (210) opposed to the card front surface (230), a card second inside surface (260) disposed on the card second panel (220) opposed to the card back surface (240), a card top edge (270) disposed on the card first panel (210) and the card second panel (220), a card bottom edge (280) disposed on the card first panel (210) and the card second panel (220) opposed to the card top edge (270), a card first edge (290) disposed on the card first panel (210), a card second edge (300 disposed on the card second panel (220), and a card first crease (310) disposed from the card top edge (270) to the card bottom edge (280), wherein the card first panel (210) is pivotally disposed on the card second panel (220) via the card first crease (310), wherein the card first crease (310) divides the card front surface (230) from the card back surface (240) and the card first inside surface (250) from the card second inside surface (260), wherein in a first open position, the card first inside surface (250) is pivoted away from the card second inside surface (260), wherein in a second closed position, the card first inside surface (250) is pivoted interfacingly against the card second inside surface (260), (ii) a protective sleeve (400) having at least a sleeve first panel (410) and a sleeve second panel (420), wherein the protective sleeve (400) comprises a sleeve front surface (430) disposed on a sleeve first panel (410), a sleeve back surface (440) disposed on a sleeve second panel (420), a sleeve first inside surface (450) disposed on the sleeve first panel (410) opposed to the sleeve front surface (430), a sleeve second inside surface (460) disposed on the sleeve second panel (420) opposed to the sleeve back surface (440), a sleeve top edge (470) disposed on the sleeve first panel (410) and the sleeve second panel (420), a sleeve bottom edge (480) disposed on the sleeve first panel (410) and the sleeve second panel (420) opposed to the sleeve top edge (470), a sleeve first edge (490) disposed on the sleeve first panel (410), a sleeve second edge (500) disposed on the sleeve second panel (420), a sleeve first inside crease (510) disposed from the sleeve top edge (470) to the sleeve bottom edge (480), and a sleeve first outside crease (520) disposed from the sleeve top edge (470) to the sleeve bottom edge (480), wherein the protective sleeve (400) comprises a sleeve cavity (530) disposed therein from the sleeve top edge (470) to the sleeve bottom edge (480) and the sleeve first edge (490) to the sleeve second edge (500), wherein the sleeve cavity (530) passes through and is not divided by the sleeve first inside crease (510) and the sleeve first outside crease (520), wherein the protective sleeve (400) comprises a single sleeve opening (540) fluidly connected to the sleeve cavity (530) disposed on the sleeve top edge (470), the sleeve bottom edge (480), the sleeve first edge (490), or the sleeve second edge (500), wherein the single sleeve opening (540) is adapted for insertion of the greeting card (200), wherein the protective sleeve (400) comprises at least three sealed edges disposed on any combination of the sleeve top edge (470), the sleeve bottom edge (480), the sleeve first edge (490), or the sleeve second edge (500), wherein the sleeve first panel (410) is pivotally disposed on the sleeve second panel (420) via the sleeve first inside crease (510) and the sleeve first outside crease (520), wherein the sleeve first outside crease (520) divides the sleeve front surface (430) from the sleeve back surface (440) and the sleeve first inside crease (510) divides the sleeve first inside surface (450) from the sleeve second inside surface (460), wherein the sleeve first inside crease (510) and the sleeve first outside crease (520) each lay on a plane, Plane A (550), wherein in a first open position, the sleeve first inside surface (450)

is pivoted away from the sleeve second inside surface (460), wherein in a second closed position, the sleeve first inside surface (450) is pivoted interfacingly against the sleeve second inside surface (460), wherein the protective sleeve (400) comprise a general shape of an envelope, wherein the sleeve front surface (430), the sleeve first inside surface (450), and the sleeve second inside surface (460) are transparent, semi-transparent or translucent, wherein the sleeve back surface (440) comprises a first attaching means (560), and (iii) a display unit (600) having a display unit front surface (610) and a display unit back surface (620), wherein the display unit front surface (610) is adapted to receive the protective sleeve (400) disposed thereon via a second attaching means (630), wherein the second attaching means (630) adapted to connectably receive the first attaching means (560), wherein the display unit back surface (620) comprises a display unit mounting component (640) disposed thereon;

(b) moving the protective sleeve (400) into the first open position;

(c) inserting the greeting card (200) into the sleeve cavity (530) of the protective sleeve (400) via the sleeve opening (540);

(d) disposing the protective sleeve (400) on the display unit (600) via the first attaching means (560) and the second attaching means (630);

(e) moving the protective sleeve (400) into the second closed position; and (f) hanging the display unit (600) on a vertical surface or setting the display unit (600) on a horizontal surface via the display unit mounting component (640).

* * * * *